US007118049B2

(12) United States Patent
Dodd

(10) Patent No.: US 7,118,049 B2
(45) Date of Patent: Oct. 10, 2006

(54) HOSE-END SPRAYER ASSEMBLY

(75) Inventor: Joseph K. Dodd, Lee's Summit, MO (US)

(73) Assignee: MeadWestvaco Corporation, Glen Allen, VA (US)

( * ) Notice: Subject to any disclaimer, the term of this patent is extended or adjusted under 35 U.S.C. 154(b) by 52 days.

(21) Appl. No.: 10/917,404

(22) Filed: Aug. 13, 2004

(65) Prior Publication Data

US 2005/0098656 A1 May 12, 2005

Related U.S. Application Data

(60) Provisional application No. 60/515,416, filed on Oct. 30, 2003.

(51) Int. Cl.
*B05B 7/30* (2006.01)

(52) U.S. Cl. ..... 239/318; 239/310; 239/347; 239/348; 239/354; 239/407; 239/413; 239/414

(58) Field of Classification Search ..... 239/310, 239/318, 347, 348, 354, 407, 413, 414, 581.1; 222/481, 481.5, 482, 484
See application file for complete search history.

(56) References Cited

U.S. PATENT DOCUMENTS 1,071,432 A 8/1913 Kelley
2,612,403 A 9/1952 Burch
2,761,734 A 9/1956 Farmer
3,034,731 A * 5/1962 Chapin ..... 239/318
3,186,643 A * 6/1965 George et al. ..... 239/318
3,201,049 A 8/1965 Hayes
3,204,875 A 9/1965 Langstroth
3,212,716 A 10/1965 Mills et al.
3,255,972 A 6/1966 Hultgren et al.
3,333,601 A 8/1967 Lofgreen
3,610,535 A 10/1971 Bradshaw
3,764,074 A * 10/1973 James ..... 239/318
3,770,205 A * 11/1973 Procter et al. ..... 239/317
3,940,069 A * 2/1976 Gunzel et al. ..... 239/318
3,964,689 A 6/1976 Horvath, Jr. et al.
4,033,509 A * 7/1977 Sheets ..... 239/226
4,057,940 A * 11/1977 Wemmer ..... 451/101
4,171,070 A 10/1979 Colgate et al.
4,315,601 A 2/1982 Brooker
4,349,157 A * 9/1982 Beiswenger et al. ..... 239/509
4,369,921 A * 1/1983 Beiswenger et al. ..... 239/317
4,475,689 A 10/1984 Hauger et al.
4,508,272 A 4/1985 Thompson
4,527,740 A 7/1985 Gunzel, Jr. et al.

(Continued)

*Primary Examiner*—David A. Scherbel
*Assistant Examiner*—Trevor McGraw
(74) *Attorney, Agent, or Firm*—Gordon & Jacobson, PC

(57) ABSTRACT

A hose-end sprayer has a selectively rotatable rotary valve received within the transverse bore of a housing which includes a carrier liquid inlet passage, a chemical liquid inlet passage and a discharge passage. The valve has a carrier liquid duct and a chemical liquid duct opening into the carrier duct for interconnecting the inlet passage in a first rotative position of the valve, and the valve is capable of closing the inlet passages in a second rotative position of the valve. The rotary valve is selectively rotatable in a third position for interconnecting the liquid passage only with the discharge passage in a rinse position of the valve. Container venting is isolated from a valve chamber in which the rotary valve operates to avoid entry of carrier liquid into the container through the open vent in the ON position of the valve upon its selective rotation.

15 Claims, 4 Drawing Sheets

U.S. PATENT DOCUMENTS 4,595,127 A 6/1986 Stoody
4,600,130 A * 7/1986 Libit ..... 222/209
D284,988 S * 8/1986 Powell ..... D23/223
4,736,891 A 4/1988 Chow et al.
4,750,674 A 6/1988 Chow et al.
4,767,058 A * 8/1988 LaRosa et al. ..... 239/309
4,901,923 A * 2/1990 McRoskey et al. ..... 239/123
4,923,098 A * 5/1990 Schoonover et al. ..... 222/465.1
5,007,588 A * 4/1991 Chow et al. ..... 239/318
5,039,016 A * 8/1991 Gunzel et al. ..... 239/314
5,100,059 A * 3/1992 Englhard et al. ..... 239/310
5,183,206 A * 2/1993 Gavin ..... 239/317
5,213,264 A 5/1993 Styne
5,213,265 A * 5/1993 Englhard et al. ..... 239/310
5,320,288 A * 6/1994 Ketcham, Jr. ..... 239/316
5,356,076 A 10/1994 Bishop
5,372,310 A * 12/1994 Ketcham ..... 239/317
5,375,769 A * 12/1994 Schultz ..... 239/310
5,383,603 A * 1/1995 Englhard et al. ..... 239/314
5,595,345 A * 1/1997 Chura et al. ..... 239/312
5,626,291 A 5/1997 Flinn et al.
H001691 H * 11/1997 Ono et al. ..... 239/3
5,804,082 A * 9/1998 Lowery, Jr. ..... 210/800
5,853,114 A * 12/1998 Giovanoli ..... 222/479
5,881,955 A 3/1999 Styne
5,944,259 A * 8/1999 Brown ..... 239/414
5,954,272 A * 9/1999 Liao ..... 239/317
5,954,273 A 9/1999 Ruta et al.
5,957,387 A * 9/1999 Porta et al. ..... 239/312
6,012,650 A * 1/2000 Hadar ..... 239/317
6,053,374 A 4/2000 Santagiuliana
6,068,204 A * 5/2000 Alexander ..... 239/310
6,102,308 A * 8/2000 Steingass et al. ..... 239/424.5
6,230,982 B1 * 5/2001 Newton ..... 239/10
6,240,983 B1 * 6/2001 Beldham et al. ..... 141/100
6,254,015 B1 * 7/2001 Abplanalp ..... 239/318
6,267,303 B1 * 7/2001 Francis ..... 239/318
6,283,385 B1 9/2001 Beaver et al.
6,345,773 B1 * 2/2002 Shanklin et al. ..... 239/318
6,371,385 B1 * 4/2002 Schiller et al. ..... 239/310
6,378,785 B1 * 4/2002 Dodd ..... 239/318
6,425,534 B1 * 7/2002 Ketcham et al. ..... 239/316
6,461,361 B1 * 10/2002 Epstein ..... 606/82
6,471,141 B1 10/2002 Smith et al.
6,578,776 B1 * 6/2003 Shanklin et al. ..... 239/318
6,604,546 B1 * 8/2003 Gilmore ..... 137/550
6,672,520 B1 1/2004 Shanklin et al.
6,708,901 B1 * 3/2004 Hubmann et al. ..... 239/310
6,749,133 B1 * 6/2004 Ketcham et al. ..... 239/318
6,752,297 B1 * 6/2004 Ische ..... 222/464.7
6,772,966 B1 * 8/2004 Foster et al. ..... 239/581.2
6,913,209 B1 * 7/2005 Shanklin et al. ..... 239/318
6,948,451 B1 * 9/2005 Bond et al. ..... 119/665
2005/0098656 A1 8/2004 Dodd

* cited by examiner

HOSE-END SPRAYER ASSEMBLY

BACKGROUND OF THE INVENTION

This application relates to a hose-end sprayer of the type set forth in U.S. Pat. No. 6,378,785, commonly owned herewith. This invention is an improvement over the venting feature disclosed in that patent, and the entirety of the disclosure of U.S. Pat. No. 6,378,785 is specifically incorporated herein by reference.

A hose-end sprayer is disclosed in U.S. Pat. No. 6,578,776 which includes a venting feature as required to replenish aspirated product from the container with air to avoid container collapse and any malfunctioning of the system. The sprayer has a cylindrical control valve 20 positioned in a cylindrical transverse bore 22 for rotation between ON and OFF positions. Valve 20 includes a sealing portion 63 that forms an annular seal with bore 22 around the interface between chemical passage 32 and a first passage 56 formed in the valve. The sprayer head assembly includes a vent passage 52 defined by a small hole formed in head 14 of the assembly. The vent passage communicates with the interior of the container and with the interior of cylindrical bore 22. Sealing member 64 on the valve includes a vent channel 68 which, in the valve open position, is aligned with vent passage 52. Accordingly, channel 68 allows passage 52 to communicate with gaps that are formed between valve 20 and its bore 22 such that in the valve open position vent passage 52 communicates with atmosphere. In the closed position of the valve, a portion of sealing member 64 overlies vent port 52 to interrupt communication with its vent channel 68 to thereby close the vent in the valve closed position. When valve 20 is rotated into its closed position, carrier passage 46, chemical passage 32, and vent passage 52 are all closed by the valve.

The sprayer head assembly of the U.S. Pat. No. 6,578,776 patent thus includes a valve chamber in communication with chemical and carrier liquid passages, with the valve movably positioned within the valve chamber. The vent passage is in communication with the valve chamber so as to likewise communicate with the carrier passage, in the valve open positions, via the gap between valve 20 and its transverse bore 22.

The drawback with such a venting system for this type of sprayer is the tendency during the vent/valve open position for liquid from the carrier passage to enter the container through the gap between 20 and 22, through vent channel 68 and through vent passage 52. This unwanted liquid, i.e., water, dilutes the chemical product in the container during repeated usage of the sprayer thus reducing the effectiveness of the chemical.

SUMMARY OF THE INVENTION

It is therefore an object of the present invention to avoid the aforenoted drawbacks and disadvantages of prior art hose-end sprayers which provide for creating a suction force that draws chemical product into the stream of the carrier liquid in a valve open position, and which have the potential for leakage of carrier liquid into the container through the open vent. This objective is achieved by the provision of venting means in the hose end sprayer assembly which is external to the valve chamber in which the rotatable valve operates for aspirating chemical product into the stream of carrier liquid in a valve open position to effect a mixing of that product on discharge. By isolating the venting means from the valve chamber, any tendency for carrier liquid to enter the container through the open vent is substantially avoided, such that any undesirable dilution of chemical liquid while in its container before being aspirated, is substantially avoided.

In carrying out this objective, the rotary valve establishes a valve chamber with the transverse bore of the housing in which it is rotatable, and the venting means is external to that valve chamber. Any potential for water entry into the container through the open vent during use of the sprayer is, therefore, prevented. Product is drawn up through the product passage and product duct of the valve into the water carrier stream in the valve open position with the open vent port isolated from the valve chamber to thereby avoid passage of carrier liquid into the chemical product in the container through the open vent which is isolated from the power stream during sprayer operation.

A pair of spaced O-rings on the rotary valve functions to seal the valve in the transverse bore and to delimit the valve chamber with the bore. And, a seal pad or the like on the rotary valve is provided for covering and uncovering a vent port in the housing which extends into the cylindrical bore outside the valve chamber for controlling the vent during valve rotation.

Other objects, advantages, and novel features of the invention will become more apparent from the following detailed description of the invention when taken in conjunction with the accompanying drawings.

DETAILED DESCRIPTION OF THE INVENTION

Figure 1:
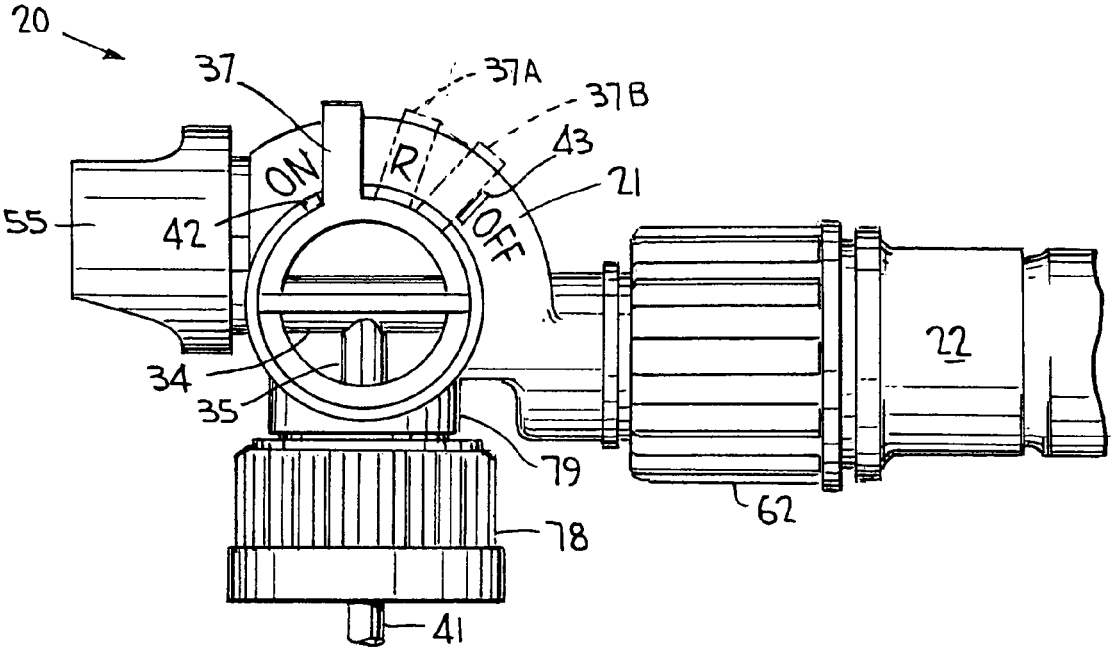
FIG. 1 is a side elevational view of a sprayer assembly according to the invention shown coupled to the end of a hose.
Figure 2:
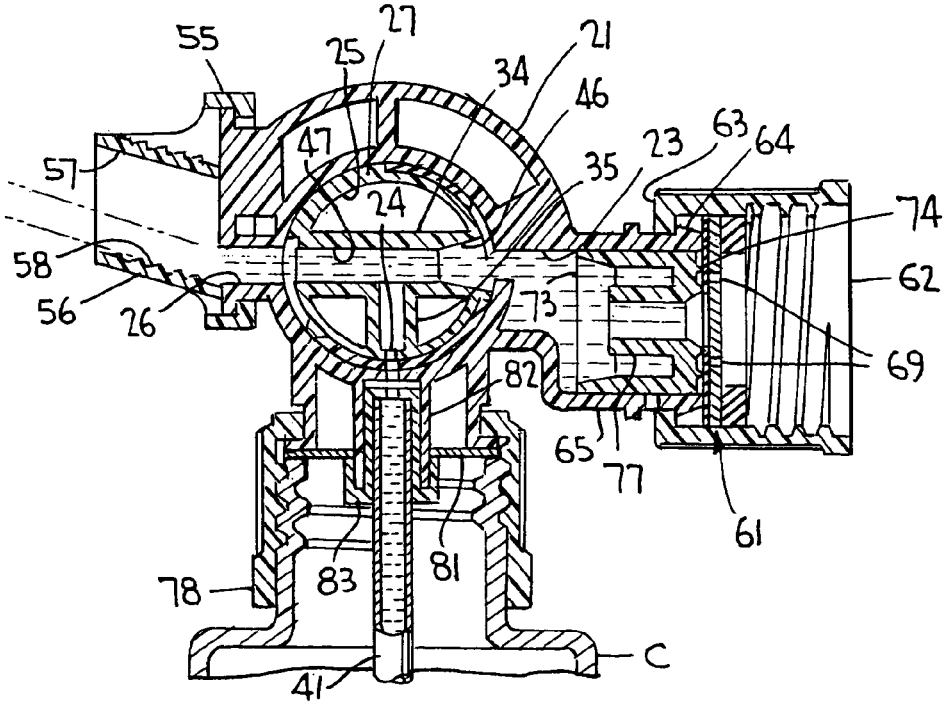
FIG. 2 is a view similar to FIG. 1 showing a structural detail end section, the valve shown in an open position with the spray diverted upwardly.
Figure 3:
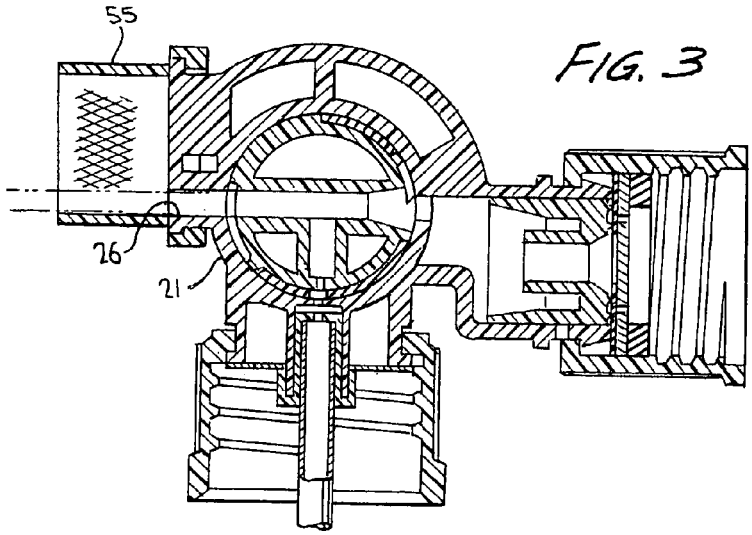
FIG. 3 is a view similar to FIG. 2, the valve shown in its ON position with the spray being undiverted.
Figure 4:
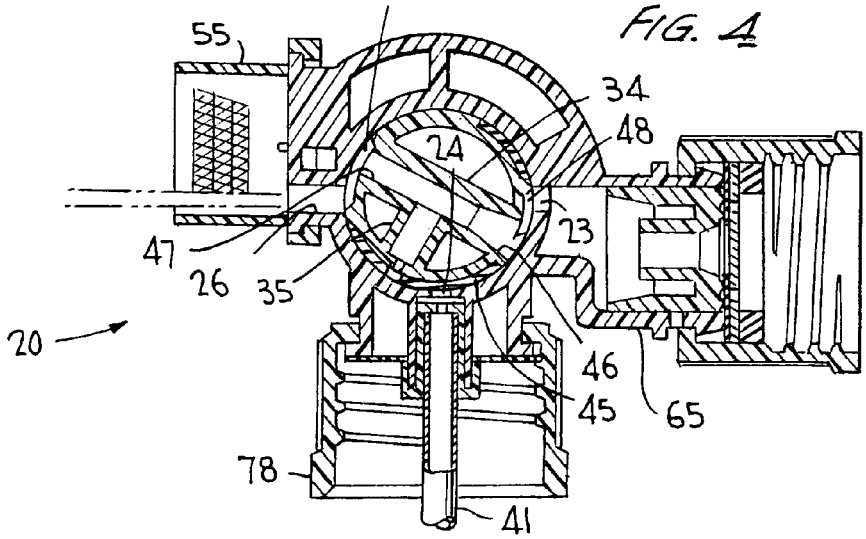
FIG. 4 is a view similar to FIG. 2 showing the valve in a rotative position with the water carrier inlet open and the chemical inlet closed in a rinse position.
Figure 5:
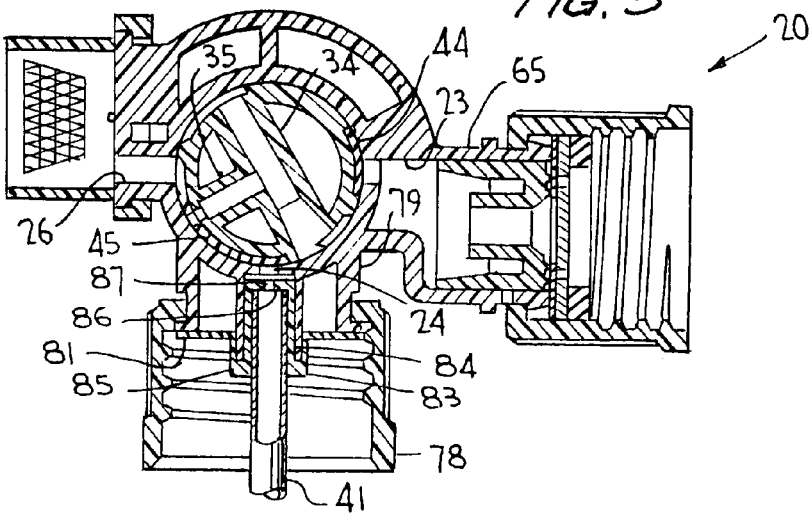
FIG. 5 is a view similar to FIG. 2 with the valve rotated to its OFF position.

Turning now to the drawings wherein like reference characters refer to like and corresponding parts throughout the several views, FIGS. 1 to 5 are taken from commonly owned U.S. Pat. No. 6,378,785, except that vent port 38 located in the rotary valve has been eliminated, and vent port 39 in the housing at the location shown has likewise been eliminated. Otherwise, the hose-end sprayer assembly which is generally designated 20 is essentially the same except that gripper bar 52 has now been eliminated, and rotatable nozzle 55 differs slightly in that the downward diversion of the spray made possible by the deflector plate 57, is no longer provided. The general structure of the hose-end assembly according to the invention is otherwise essentially the same as that disclosed in the U.S. Pat. No. 6,378,785 patent, such that further detailed description of the elements and their function will not be duplicated since the same is set forth in detail in that patent, with the entirety of its disclosure being specifically incorporated herein by reference.

Figure 6:
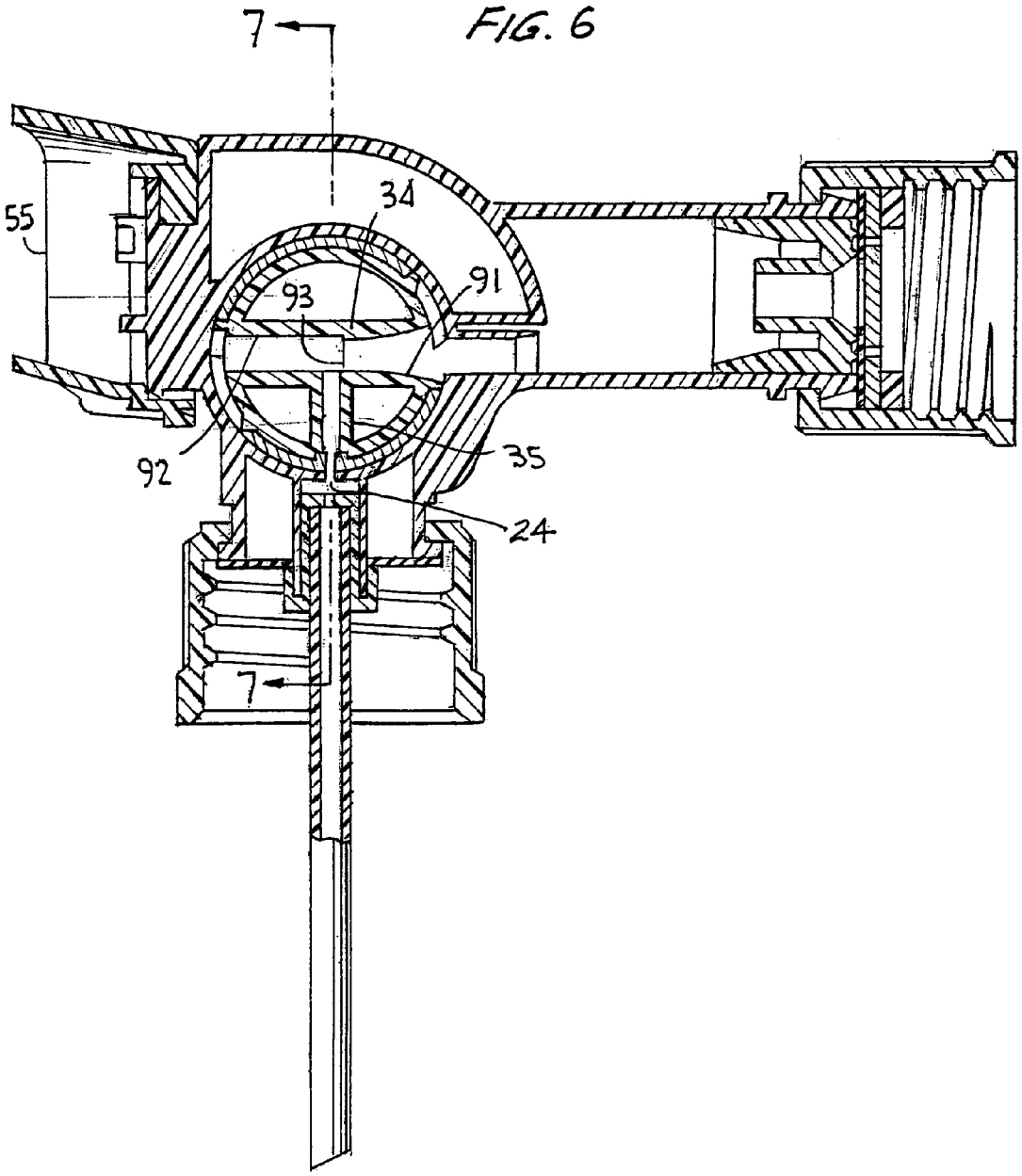
FIG. 6 is a view similar to FIG. 2 showing refinements in the sprayer assembly.

Hose-end sprayer 20 according to the invention is shown in FIG. 6 which includes a refinement in carrier liquid inlet duct 34 in the form of a venturi section 91 formed as having a gradually reducing inner diameter so as to constrict the flow of carrier fluid in the ON position of the rotary valve during its movement therealong. Inlet duct 34 likewise has a tube section 92 of essentially constant diameter larger than the smallest diameter of venturi section 91 at juncture 93. Juncture 93 is, as seen, slightly upstream of the terminal opening of duct 35. Therefore, as the carrier liquid flows along section 91 from right to left when viewed in FIG. 6, the carrier fluid pressure drops at juncture 93 upon entering larger diameter section 92 thereby suctioning chemical product up the dip tube and through duct 35 into the carrier stream, in accordance with the well-understood principles of the venturi effect. Chemical product aspirated into the carrier stream thus mixes therewith and is discharged through the open end of duct section 92 into rotatable nozzle 55 which can be diverted upwardly as in FIG. 2, or undiverted as in FIG. 4. The rotatable cylindrical valve 27 is provided with an elastomeric section 44 on its outer periphery which includes an external seal portion 45 which seals tightly over chemical liquid inlet passage 24 in the valve closed position of FIG. 7.

Figure 8:
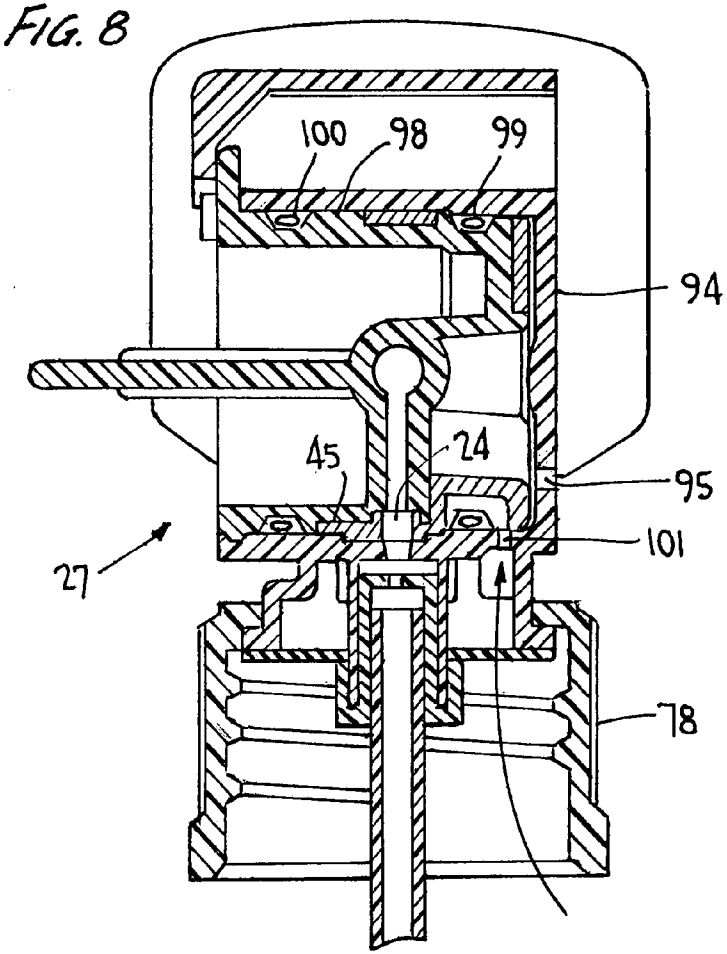
FIG. 8 is a view similar to FIG. 7 with the rotary valve shown rotated in a valve open and vent open position.
Figure 7:
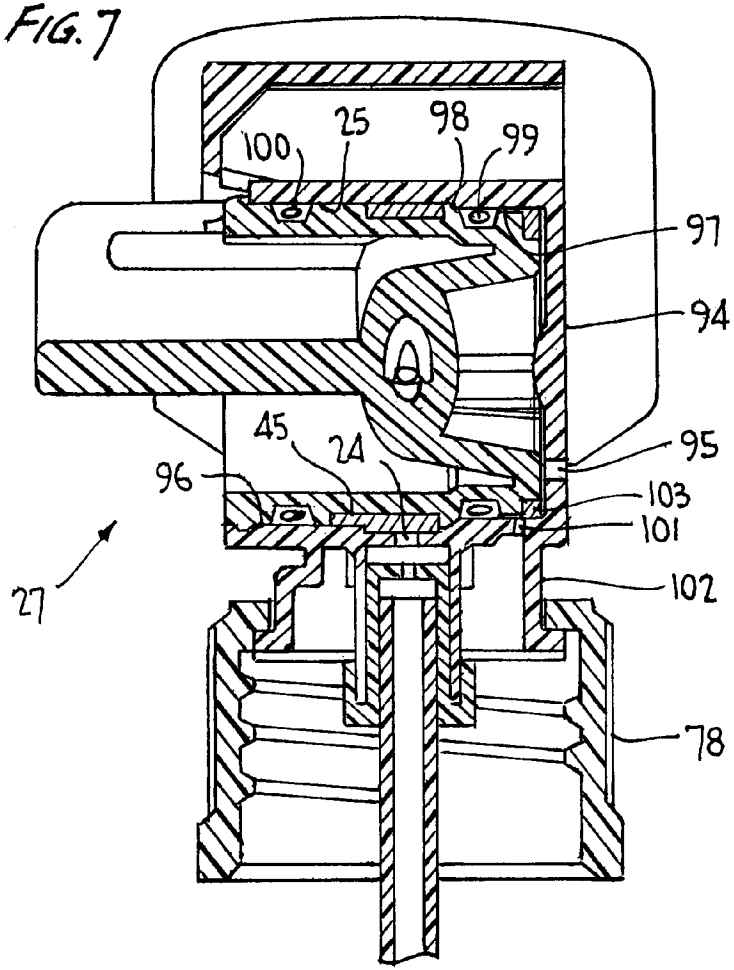
FIG. 7 is a vertical sectional view taken substantially along the line 7—7 of FIG. 6 with the rotary valve shown rotated into a valve closed and vent closed position.

Transverse bore 25 of the housing may be provided with an end wall 94 having a bleed port 95. And, as shown in FIGS. 7 and 8, transverse bore 25 has a major diameter section 96 and an inner, slightly smaller diameter section 97. The comparative diameter sections of the transverse bore facilitate assembling of the parts without interference, among other advantages. And, since valve 27 behaves as a piston during assembly within the transverse bore, it tends to compress air within the bore providing some unwanted resistance to proper seating of the rotary valve within its chamber. Therefore, bleed port 95 is provided in end wall 94 for venting air out of the transverse bore on assembly of the rotary valve. Otherwise, end wall 94 can be eliminated in its entirety, or a partial end wall of some type having an air passage or passages can be provided instead, all without departing from the invention.

The rotary valve forms a valve chamber 98 with the transverse bore on insertion therewithin. That valve chamber is delimited by a pair of quad (seal) rings 99 and 100, the inner quad ring 99 being of slightly smaller diameter to accommodate the slightly smaller diameter of section 97 of the bore.

In accordance with the invention, the container venting system is located external to the valve chamber so as to be isolated therefrom, as clearly shown in FIGS. 7, 8. The venting system comprises a vent port 101 which may be located in the smaller diameter section 97. The vent port communicates with the interior of the container (not shown) through the interior of container closure 78 via a vent duct 102 formed integrally with the housing. A portion of elastomeric section 44 on the exterior of the rotary valve includes an external seal portion 103 which may effectively form a seal pad which covers vent port 101 in the vent and valve closed position of FIG. 7. The elastomeric section 44 on the periphery of the rotary valve is designed such that there is no pad which overlies vent port 101 upon rotation of the rotary valve to its ON position which coincides with the vent open position of FIG. 8.

From the foregoing it can be seen that the improved venting system for a hose-end sprayer in accordance with the present invention avoids many of the noted disadvantages and drawbacks of prior art hose-end sprayers of this type in a simple and efficient yet highly effective manner. The venting system is isolated from and is external to the valve chamber in which the chemical liquid product is ingested or aspirated into the path of the carrier liquid to be diluted and discharged from the duct 34 of the valve. There is in accordance with this arrangement less likelihood for entry of carrier liquid into the chemical container through the open vent which is caused to open upon selective rotation of the rotary valve to the ON position of the sprayer. The vent is isolated from and external to the valve chamber delimited by O-rings 99, 100. Thus, vent port 101 is separated from the valve chamber by seal 99 such that as the carrier liquid aspirates chemical product through port 24 into duct 34, any tendency of water passing between valve 27 and its transverse bore 25 is confined to the space between O-rings 99 and 100. With the present arrangement, only chemical port 24 lies between the two O-rings. Water cannot enter the container through open port 24 through which chemical product is being drawn. And, water cannot enter the container through open vent port 101 which is sealingly isolated from the flow of water through duct 34. Thus, according to the invention, the chemical product in the container remains pure and undiluted throughout repeated use of the hose end sprayer.

The rotary valve has an elastomeric section on its outer periphery which includes a seal portion or a pad 103 positioned in a manner such that when the valve is selectively rotated to its OFF position of FIG. 7, pad 103 overlies port 101 in sealing relationship for closing the vent. Upon selective rotation of the valve 27 into its ON position of spray, the elastomeric section 44 on the outer periphery of the cylindrical valve is devoid of any portion which would overlie vent port 101 in the FIG. 8 position. The vent is thus open facilitating entry of air into the container via open vent port 101 and bleed port 95 to replenish the volume in the container with air upon the discharge of product therefrom so as to avoid container collapse and interference with the aspiration of product into the carrier stream. It is to be noted that end wall 94 can be eliminated entirely or partially in which case the entirety of the back wall of the rotary valve is exposed to atmosphere such that in the open position of the vent the interior of the container is exposed directly to atmosphere through the open back side of the housing.

Obviously, many modifications and variations of the present invention are made possible in the light of the above teachings. It is therefore to be understood that within the scope of the appended claims, the invention may be practiced otherwise than as specifically described.

What is claimed is:

1. A hose-end sprayer assembly for connection to a container of product, comprising: a housing having a carrier liquid inlet passage, a liquid product inlet opening and a discharge passage; a rotary valve mounted within said housing and comprising a liquid duct and a product duct opening into said liquid duct; the housing having a transverse bore having a portion which together with the valve defines a valve chamber; the valve being selectively rotatable within the transverse bore for interconnecting said carrier liquid inlet passage and said liquid product inlet opening with said discharge passage in a first rotative position of the valve; and the assembly having means exterior to the valve chamber for venting the interior of the container to atmosphere in the first position and for interrupting communication between the container interior and atmosphere in a second selectively rotatable position of the valve in which the carrier liquid inlet passage and the liquid product inlet opening are both out of communication with the discharge passage.

2. The sprayer assembly according to claim 1, wherein said rotary valve is selectively rotatable in a third rotative position in which said carrier liquid inlet passageway is interconnected with said discharge passage and said liquid product inlet opening is out of communication with said discharge passage.

3. The sprayer assembly according to claim 1, wherein the venting means comprises a vent port in the housing in communication with the atmosphere, and means on the rotary valve is provided for opening and closing the vent port respectively in the first and second rotative positions of the valve.

4. The sprayer assembly according to claim 3, wherein said means on the rotary valve comprises a seal pad for covering and uncovering the vent port respectively in the first and second rotative positions of the valve.

5. The sprayer assembly according to claim 1, wherein the venting means comprises a vent port in communication with the atmosphere and opening into the transverse bore external to the valve chamber, and the valve comprising a wall portion for opening and closing the vent port respectively in the first and second rotative positions of the valve.

6. The sprayer assembly according to claim 5, wherein said wall portion has a seal pad for covering and uncovering the vent port respectively in the first and second rotative positions of the valve.

7. The sprayer assembly according to claim 1, wherein a pair of spaced apart seal rings on the rotary valve sealingly engage the transverse bore and delimit the valve chamber within the transverse bore.

8. The sprayer assembly according to claim 7, wherein the venting means comprise a vent in the housing in communication with the atmosphere and outside the chamber adjacent an inner one of the seal rings.

9. A hose-end sprayer assembly for connection to a container of product, comprising:

a housing having a hose coupling that extends to a carrier liquid inlet passage, a container coupling that extends to a liquid product inlet opening, a discharge passage, and a transverse bore;

a rotary valve mounted within said transverse bore, said rotary valve having a liquid duct and a product duct leading into said liquid duct;

seal rings disposed between said rotary valve and said transverse bore, said seal rings spaced apart from one another and delimiting a valve chamber therebetween into which extends said liquid product inlet opening; and venting means disposed exterior from said valve chamber;

wherein said rotary valve is selectively rotatable into first and second positions, wherein in said first position said carrier liquid inlet passage and said liquid product inlet opening are both fluidily coupled to said discharge passage and said venting means operates to vent the interior of the container to atmosphere, and in said second position said carrier liquid inlet passage and said liquid product inlet opening are both fluidily decoupled from said discharge passage and said venting means operates to block venting of the interior of the container to atmosphere.

10. The sprayer assembly according to claim 9, wherein:

said rotary valve is selectively rotatable in a third position, wherein in said third position said carrier liquid inlet passageway is fluidly coupled to said discharge passage and said liquid product inlet opening is fluidly decoupled from said discharge passage.

11. The sprayer assembly according to claim 9, wherein:

said venting means comprises a vent port in the housing in fluid communication with atmosphere, and means on the rotary valve is provided for opening and closing the vent port in said first and second positions, respectively.

12. The sprayer assembly according to claim 11, wherein:

said vent port is adjacent one of said seal rings.

13. The sprayer assembly according to claim 11, wherein said means on the rotary valve comprises a seal pad for covering and uncovering the vent port in said first and second positions, respectively.

14. The sprayer assembly according to claim 11, wherein said means in the rotary valve comprises a wall portion for opening and closing the vent port in said first and second positions, respectively.

15. The sprayer assembly according to claim 14, where said wall portion has a seal pad for covering and uncovering the vent port in said first and second positions, respectively.

* * * * *